US012595631B2

(12) United States Patent
Wiegel et al.

(10) Patent No.: US 12,595,631 B2
(45) Date of Patent: Apr. 7, 2026

(54) BARRIER SYSTEMS WITH IMPACT RESISTANT RAILS SUPPORTED FROM FLOOR MOUNTED POST BASES

(71) Applicant: Rite-Hite Holding Corporation, Milwaukee, WI (US)

(72) Inventors: Aaron Wiegel, Milwaukee, WI (US); Jason Dondlinger, Bellevue, IA (US); Nick Casey, Cascade, IA (US); Butch Korman, Dubuque, IA (US); Tony Duesing, Bellevue, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 406 days.

(21) Appl. No.: 17/984,952

(22) Filed: Nov. 10, 2022

(65) Prior Publication Data

US 2023/0151569 A1 May 18, 2023

Related U.S. Application Data

(60) Provisional application No. 63/279,165, filed on Nov. 14, 2021.

(51) Int. Cl.
*E01F 15/04* (2006.01)

(52) U.S. Cl.
CPC ..... *E01F 15/0423* (2013.01); *E01F 15/0461* (2013.01); *E01F 15/0484* (2013.01)

(58) Field of Classification Search
CPC ..... E04H 17/009; E04H 17/20; E04H 17/21; E04H 17/14; E04H 17/1413;
(Continued)

(56) References Cited

U.S. PATENT DOCUMENTS 2,557,002 A * 6/1951 Lathrop ..... E04F 11/181 256/65.12
2,946,568 A * 7/1960 Ogden ..... E04F 11/181 403/264

(Continued)

FOREIGN PATENT DOCUMENTS

BE 1027592 A1 4/2021
CN 212837076 U 3/2021

(Continued)

OTHER PUBLICATIONS

A-Safe Inc, "iFlex Pedestrian Barrier 3 Rail," accessed Mar. 21, 2023, at https://webcdn.asafe.com/store/media/mejkn3ez/iflex_pedestrian_3_rail_guardrail_us.pdf, 3 pages.

(Continued)

*Primary Examiner* — Jonathan P Masinick
(74) *Attorney, Agent, or Firm* — Hanley, Flight & Zimmerman, LLC

(57) ABSTRACT

Methods, apparatus, systems, and articles of manufacture for barrier systems with impact resistant rails supported from floor mounted post bases are disclosed. An apparatus includes an outer body of a post to extend upward from a ground, the post to be anchored to the ground; a rail to extend through an opening in a wall of the outer body; and a rod to extend upward from the ground within the outer body, the rod to extend through a hole in the rail.

19 Claims, 7 Drawing Sheets

(58) Field of Classification Search
CPC ..... E04H 17/1447; E04H 17/1465; E04H 17/1478; E04H 17/1488; E01F 15/04; E01F 15/0407; E01F 15/0423; E01F 15/0453; E01F 15/0461
See application file for complete search history.

(56) References Cited

U.S. PATENT DOCUMENTS

| | | | | | |
|---|---|---|---|---|---|
| 3,462,126 | A * | 8/1969 | Demanega | E01F 13/024 | 52/298 |
| 3,820,909 | A * | 6/1974 | Schindler et al. | F16B 7/04 | 403/205 |
| 3,921,960 | A * | 11/1975 | Bright | E04H 17/1413 | 256/65.12 |
| 4,477,059 | A * | 10/1984 | Willis | E04H 17/1413 | 403/292 |
| 5,312,089 | A | 5/1994 | Venegas, Jr. | | |
| 6,142,453 | A * | 11/2000 | Martin | E04H 17/1413 | 256/65.05 |
| 6,213,452 | B1 * | 4/2001 | Pettit | E04F 11/1812 | 248/527 |
| 6,679,481 | B2 * | 1/2004 | McNalley | E04H 17/1413 | 256/65.01 |
| 7,243,473 | B2 * | 7/2007 | Terrels | E04C 3/32 | 52/843 |
| 8,424,851 | B2 * | 4/2013 | Christoffer | E01F 13/022 | 256/65.14 |
| 9,066,493 | B2 * | 6/2015 | Barzani | A01K 15/027 | |
| 9,663,965 | B2 * | 5/2017 | Ramon | E01F 13/022 | |
| 2004/0004211 | A1 * | 1/2004 | McEnroe, Jr. | E04G 21/185 | 256/65.04 |
| 2006/0255327 | A1 * | 11/2006 | Johnston | E04H 17/1413 | 256/59 |
| 2012/0131879 | A1 * | 5/2012 | Bergman | E04F 11/1812 | 52/704 |
| 2024/0401289 | A1 * | 12/2024 | Dondlinger | B65G 69/287 | |

FOREIGN PATENT DOCUMENTS

| | | | | |
|---|---|---|---|---|
| GB | 1207337 | A | 9/1970 | |
| GB | 2522278 | A * | 7/2015 | E01F 13/022 |
| KR | 970009836 | U | 3/1997 | |
| KR | 20110021168 | A * | 3/2011 | |

OTHER PUBLICATIONS

International Searching Authority, "International Search Report and Written Opinion," issued in connection with International Application No. PCT/US2022/049593, on Mar. 21, 2023, 14 pages.
Australian Government, IP Australia, "Patent Examination Report No. 1," issued in connection with Australian Patent Application No. 2022384249, issued on Mar. 31, 2025, 5 pages.
United Kingdom Patent Office, "Examination Report under Section 18(3)," issued in connection with United Kingdom Patent Application No. 2406436.2, dated May 23, 2025, 3 pages.
A-Safe, "Technical downloads," retrieved from <https://web.archive.org/web/20211023103220/https://www.asafe.com/en-us/resources/technical-downloads/> on Feb. 26, 2026, 7 pages.
A-Safe, "iFlex: Single Car park Barrier," Installation Guide, retrieved from <https://www.asafe.com/media/12069/iflex_single_carparkbarrier_install_guide.pdf> on Feb. 26, 2026, 5 pages.

* cited by examiner

BARRIER SYSTEMS WITH IMPACT RESISTANT RAILS SUPPORTED FROM FLOOR MOUNTED POST BASES

RELATED APPLICATIONS

This patent claims the benefit of U.S. Provisional Patent Application No. 63/279,165, which was filed on Nov. 14, 2021. U.S. Provisional Patent Application No. 63/279,165 is incorporated herein by reference in its entirety. Priority to U.S. Provisional Patent Application No. 63/279,165 is claimed.

FIELD OF THE DISCLOSURE

This disclosure relates generally to barrier systems and, more particularly, to barrier systems with impact resistant rails supported from floor mounted post bases.

BACKGROUND

Barrier systems are often implemented on roadways, driveways, loading docks, rail or finger docks, factories, and warehouse floors. Some such barrier systems include one or more rails that extend horizontally between vertical posts. In some instances, the vertical posts are anchored to the floor to provide a barrier that is able to resist and/or withstand certain impacts to the posts and/or rails.

Figure 1:
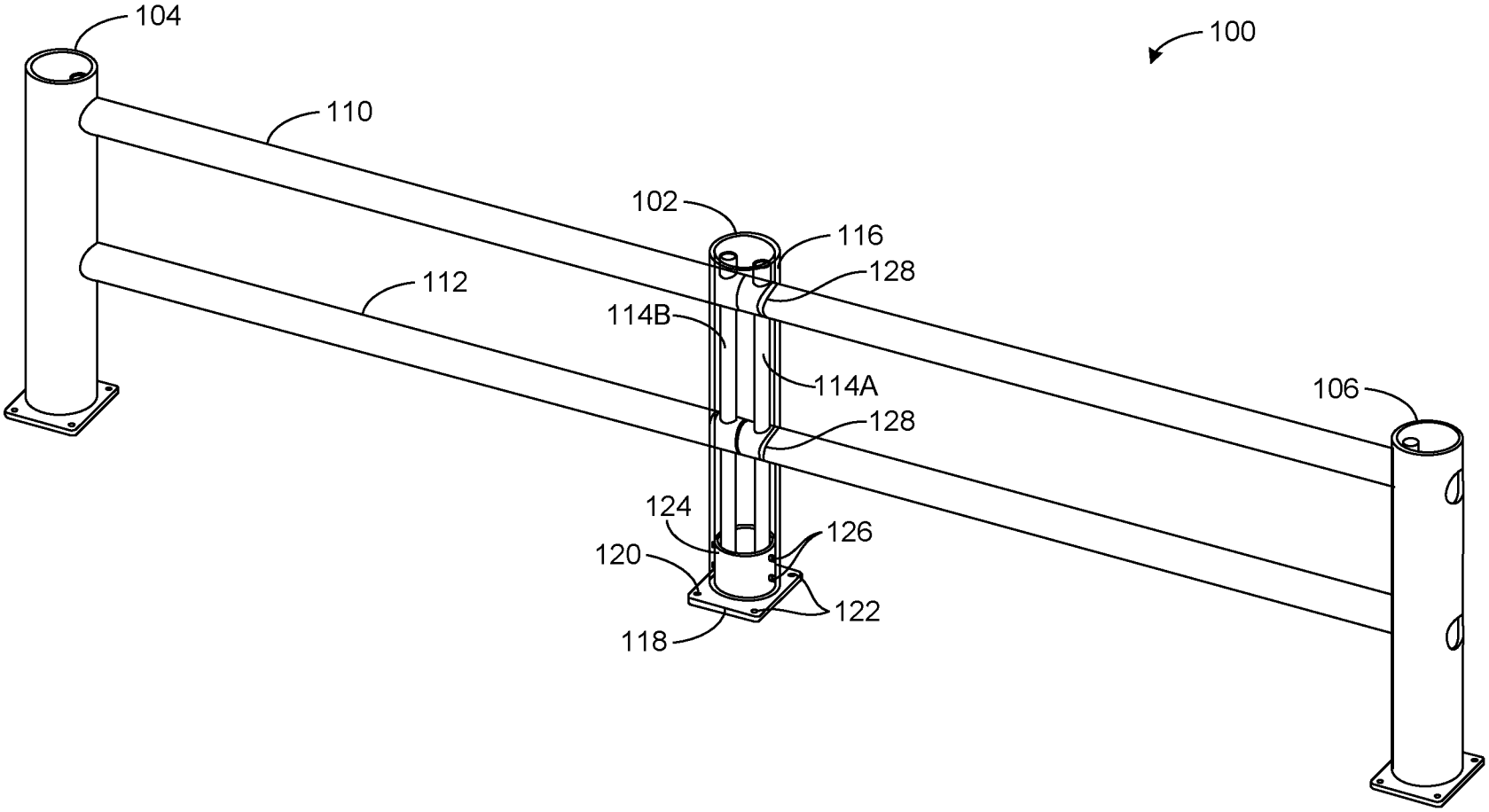
FIG. 1 is a perspective view of an example barrier system implemented in accordance with teachings of this disclosure including an example post.

In general, the same reference numbers will be used throughout the drawing(s) and accompanying written description to refer to the same or like parts. The figures are not necessarily to scale. Instead, the thickness of the layers or regions may be enlarged in the drawings. As used herein, unless otherwise stated, the term "above" describes the relationship of two parts relative to Earth. A first part is above a second part, if the second part has at least one part between Earth and the first part. Likewise, as used herein, a first part is "below" a second part when the first part is closer to the Earth than the second part. As noted above, a first part can be above or below a second part with one or more of:

other parts therebetween, without other parts therebetween, with the first and second parts touching, or without the first and second parts being in direct contact with one another.

As used in this patent, stating that any part (e.g., a layer, film, area, region, or plate) is in any way on (e.g., positioned on, located on, disposed on, or formed on, etc.) another part, indicates that the referenced part is either in contact with the other part, or that the referenced part is above the other part with one or more intermediate part(s) located therebetween.

As used herein, connection references (e.g., attached, coupled, connected, and joined) may include intermediate members between the elements referenced by the connection reference and/or relative movement between those elements unless otherwise indicated. As such, connection references do not necessarily infer that two elements are directly connected and/or in fixed relation to each other. As used herein, stating that any part is in "contact" with another part is defined to mean that there is no intermediate part between the two parts. As used herein, "approximately" and "about" refer to dimensions that may not be exact due to manufacturing tolerances and/or other real world imperfections.

Unless specifically stated otherwise, descriptors such as "first," "second," "third," etc., are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly that might, for example, otherwise share a same name.

DETAILED DESCRIPTION

Many barrier systems (also referred to herein as guard rail systems, or barriers) include a plurality of spaced apart posts with rails extending therebetween. In some barrier systems, multiple rails may extend between adjacent posts at different locations along the height of the posts. In some examples, the rails are composed of plastics and/or other materials that provide some flexibility or resilience in response to an impact. However, such materials are susceptible to shearing or deformation near the posts if an impact occurs near the center of the rails. By contrast, the posts, or at least bases supporting the posts, are made of a rigid material (e.g., metal) that provides the structural strength and rigidity to secure the posts to the ground or floor. Examples disclosed herein enable the coupling of such flexible rails to rigid post bases so as to take advantage of both the elastic deformability of the rails and the inelastic sturdiness of the post bases plates while reducing the likelihood of damage to components in the event of an impact with the barrier system. Though the description refers to plastic rails and metal post bases, it should be understood that the scope of the disclosure includes rails and/or post bases of other materials and that the rails are relatively more flexible (less rigid) than the post bases.

FIG. 1 is a perspective view of an example barrier 100 implemented in accordance with teachings of this disclosure. In the illustrated example of FIG. 1, the barrier 100 includes an example first post 102, an example second post 104, and an example third post 106. In the illustrated example of FIG. 1, exterior of the first post 102 is see-through for purposes of illustration to enable the interior components to be visible. The example barrier 100 of FIG. 1 includes an example first rail 110 including separate portions extending between adjacent ones of the posts 102, 104, 106 at a first height and an example second rail 112 including separate portions extending between adjacent ones of the posts 102, 104, 106 at a second height that is lower than the first height from the ground.

The barrier 100 is configured to withstand impacts from vehicles (e.g., fork trucks) and other heavy equipment. In some examples, the barrier 100 is anchored (e.g., coupled, etc.) to the floor via the posts 102, 104, 106 and one or more fasteners (e.g., bolts, etc.). While the barrier 100 is depicted with the three posts 102, 104, 106 and the two rails 110, 112, the barrier 100 can have any suitable number of posts and/or rails. In other examples, the path of the barrier 100 may include corners and/or otherwise follow a non-straight line.

The rails 110, 112 are horizontally oriented structural elements that transfer shear (or transverse) impacts to the barrier to the ground via the posts 102, 104, 106. In the illustrated example of FIG. 1, the rails 110, 112 extend between the posts 102, 104, 106. In the illustrated example of FIG. 1, the rails 110, 112 are hollow tubular elements. In other examples, the rails 110, 112 can be solid elements and/or have any other suitable shape. In some examples, the rails 110, 112 can be composed of High Density Polyethylene (HDPE). In other examples, the rails 110, 112 can be composed of any other suitable materials (e.g., another plastic, a polymer, a metal, etc.). In the illustrated example of FIG. 1, the rails 110, 112 are composed of discrete segments (e.g., different tubes, etc.) that extend between adjacent ones of the posts 102, 104, 106. In other examples, the rails 110, 112 can be composed of a unitary structural element that extends all the way through one or more of the posts 102, 104, 106.

The posts 102, 104, 106 are vertically oriented structural elements that anchor the barrier 100 to the ground or floor. In some examples, impacts to the rails 110, 112 are transferred to the posts 102, 104, 106 to protect people and/or objects on the other side of the barrier 100. In the illustrated example, the posts 102, 104, 106 are hollow tubular elements. In other examples, the posts 102, 104, 106 can be solid elements and/or have any other suitable shape. In some examples, the posts 102, 104, 106 can be composed of High Density Polyethylene (HDPE). In other examples, the posts 102, 104, 106 can be composed of any other suitable materials (e.g., another plastic, a polymer, a metal, etc.).

Figure 3:
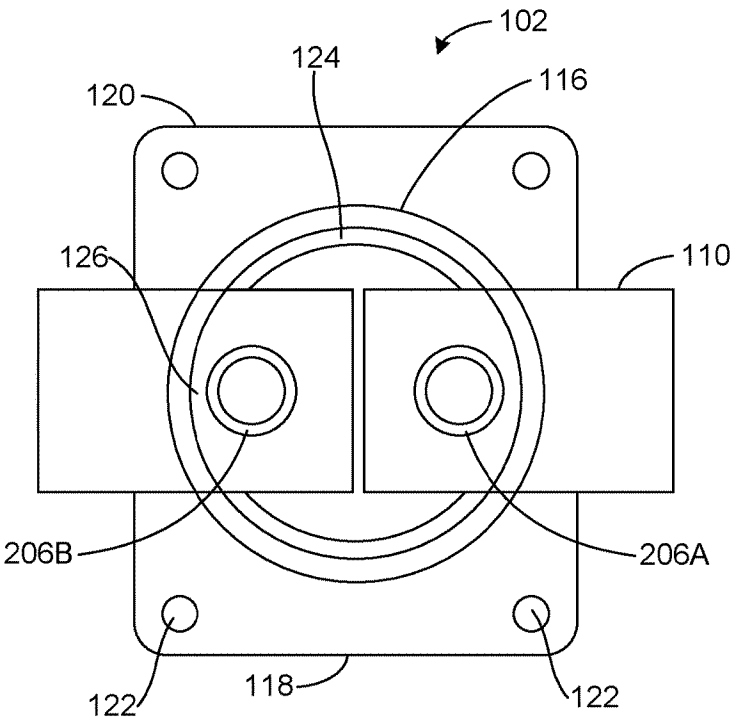
FIG. 3 is a top view of the example post of FIGS. 1 and 2.
Figure 2:
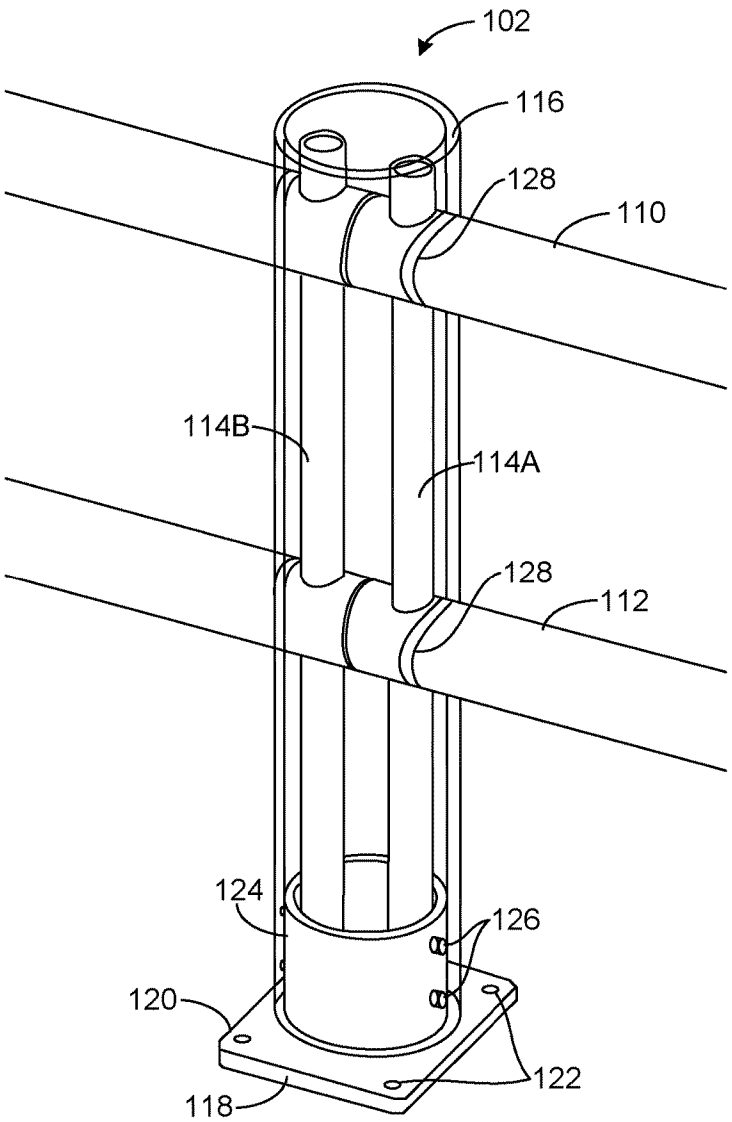
FIG. 2 is an enlarged perspective view of the example post of FIG. 1.

An enlarged perspective view of the first post 102 is illustrated in FIG. 2. A top down view of the first post 102 is shown in FIG. 3. As with FIG. 1, the exterior of the post 102 shown in FIGS. 2 and 3 is see-through or transparent for purposes of explanation. As shown in the illustrated examples of FIGS. 1-3, the first post 102 includes an example first rod 114A, an example second rod 114B, an example outer body 116, and an example anchor 118. The example anchor 118 is the portion of the post 102 coupled to the ground or floor. In the illustrated example of FIG. 2, the anchor 118 includes a base plate 120 with mounting holes 122 to enable one or more fasteners or anchors (e.g., bolts, etc.) to secure the anchor 118 to the floor. Further, the anchor includes a cylindrical portion 124 that protrudes upwards from the base plate 120. In some examples, both the base plate 120 and the cylindrical portion 124 are composed of a rigid material (e.g., steel) to provide structural stability for the barrier 100. In other examples, the anchor 118 can be composed of any other suitable materials (e.g., plastic, metal, polymer, etc.) or combination thereof. In some examples the cylindrical portion 124 is affixed (e.g., welded) to the base plate 120. In other examples, the cylindrical portion 124 is integrally formed with the base plate 120. In other examples, the anchor 118 can have any other suitable shape, orientation, and/or features to rigidly couple the post 102 to the ground or floor.

As shown in the illustrated example, the cylindrical portion 124 is to receive or fit within the inner diameter of the outer body 116. In other examples, the cylindrical portion of the anchor 118 can receive or surround the outer diameter of the outer body 116. In some examples, one or more retaining elements (e.g., threaded fasteners) may be used to couple the outer body 116 to the cylindrical portion 124 of the anchor 118 (e.g., via associated holes 126). In the illustrated example of FIG. 2, the outer body 116 is not fixed or coupled (e.g., not via fasteners, chemical adhesives, press fits, etc.) to the rods 114A, 114B or the rails 110, 112 such that the rods 114A, 114B and the rails 110, 112 are free to move relative to the outer body 116. However, due to the interlocking relationship of the different components, such movement is relatively constrained without disassembling the barrier 100. In some examples, the connection between the outer body 116 and the cylindrical portion 124 of the anchor 118 is sealed in any suitable manner (e.g., via a gasket, an O-ring, a grommet. etc.). In the illustrated example of FIG. 2, the outer body 116 is composed of High Density Polyethylene (HDPE). In other examples, the outer body 116 can be composed of any suitable material (e.g., another plastic, a metal, a polymer, etc.) or combination thereof. In the illustrated example, the outer body 116 includes through holes or openings 128 to receive the rails 110, 112. In some examples, the joints between the outer body 116 and the rails 110, 112 (e.g., at the openings 128) are sealed in any suitable manner (e.g., via a gasket, an O-ring, a grommet, etc.). In some such examples, the weight of the rails 110, 112 is supported by the outer body 116 via the through holes. Further, the example outer body 116 is an outer shell that surrounds the rods 114A, 114B.

The example rods 114A, 114B are structural elements that transfer force in shear from the rails 110, 112 to the anchor 118. In the illustrated example of FIG. 2, the rods 114A, 114B are vertically oriented and pass through corresponding holes of the rails 110, 112. In some examples, the rods 114A, 114B may provide some support for the rails 110, 112 in addition to or instead of the outer body 116 due to the connection between the rods 114A, 114B and the rails 110, 112. In the illustrated example of FIG. 2, the receiving through holes in the rails 110, 112 are circular and generally have the same cross-sectional shape as the rods 114A, 114B. In other examples, the receiving through holes in the rails 110, 112 can be slots (elongate in a direction of the main axis of the rails 110, 112, etc.) to enable the movement of the rods 114A, 114B laterally (e.g., in the direction of the main axis of the rails 110, 112, etc.) relative to the rails 110, 112.

In some examples, the rods 114A, 114B rest on the base plate 120 within the cylindrical portion 124 of the anchor 118 without being directly attached to the anchor 118 (e.g., the rods 114A, 114B are freestanding on the anchor 118). In this manner, the rods 114A, 114B are able to move relative to the anchor 118 when, for example, the barrier 100 is subject to an impact. However, as the rods 114A, 114B move in response to an impact, the rods 114A, 114B may come into contact with the cylindrical portion 124 thereby preventing significant movement of the rods 114A, 114B, which in turn provides stability for the barrier 100. In such examples, the vertical orientation of the freestanding rods 114A, 114B is maintained by virtue of the rods extending through the holes in the rails 110, 112, which in turn extend through the holes in the outer body 116. In some examples, the anchor 118 can include features (e.g., depressions, projections, threaded elements, etc.) to specifically retain the ends of rods 114A, 114B. In the illustrated example of FIG. 2, the rods 114A, 114B are tubes. In other examples, the rods can be solid and/or any other suitable shape (e.g., ovoid, polygonal, flat, etc.). In this example, the rods 114A, 114B are composed of a rigid material (e.g., steel). In other examples, the rods 114A, 114B can be composed of any suitable material (e.g., plastic, metal, polymer, etc.) or combination thereof.

While not explicitly described herein, the other posts 104, 106 can have any suitable configuration, material composition, and include any suitable mechanical components. For example, the other posts 104, 106 can have the same form and material composition as the first post 102. In other examples, if the other posts 104, 106 are end posts, the ends posts can include a single rod (e.g., corresponding to the rods 114A, 114B, etc.). In other examples, the other posts 104, 106 can include any other suitable configuration, form, and/or material compositions.

Figure 4:
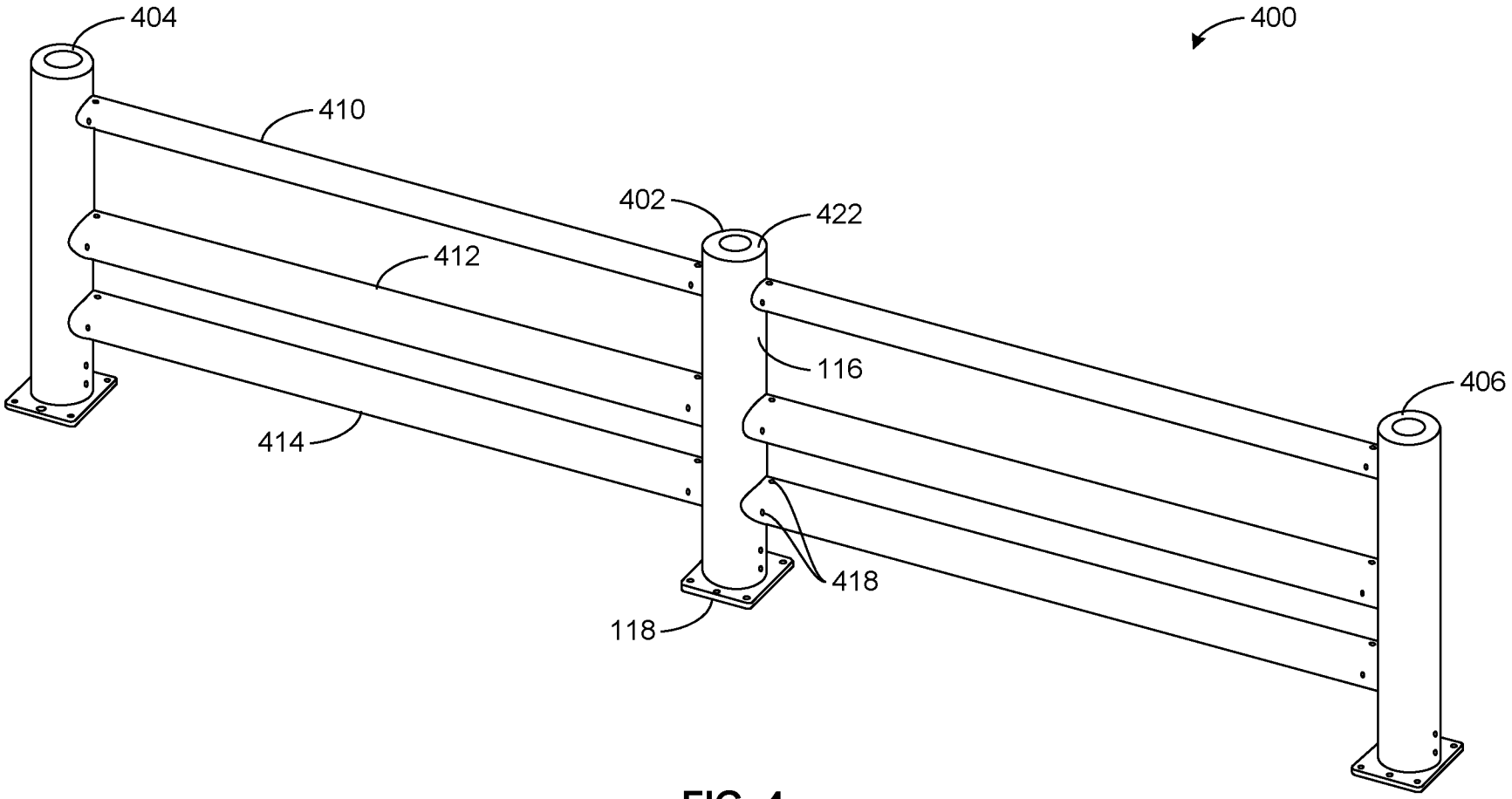
FIG. 4 is a perspective view of another example barrier system implemented in accordance with teachings of this disclosure including an example post.
Figure 5:
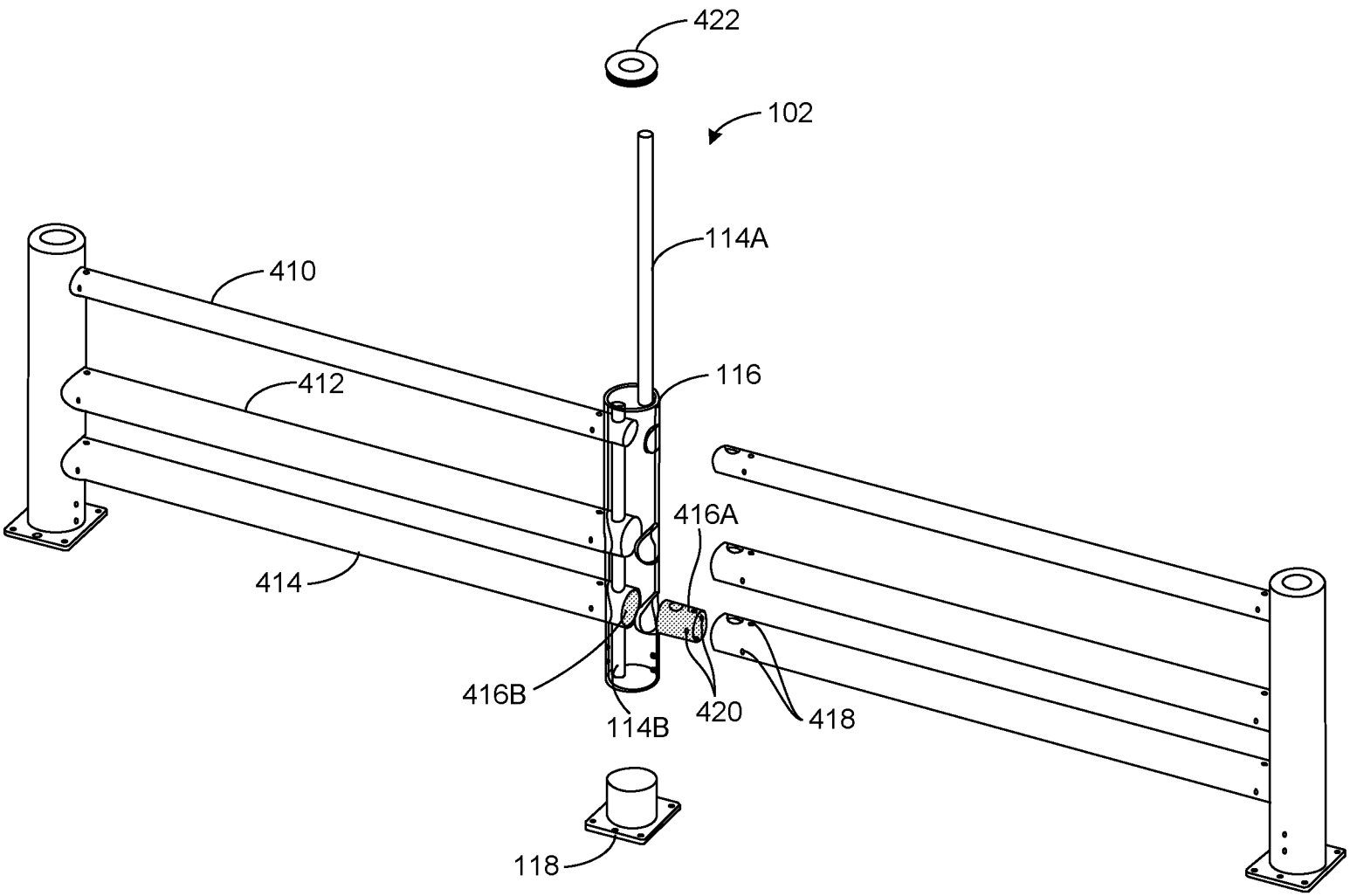
FIG. 5 is a perspective view of the example barrier system of FIG. 4 including an exploded view of the example post of FIG. 4.
Figure 7:
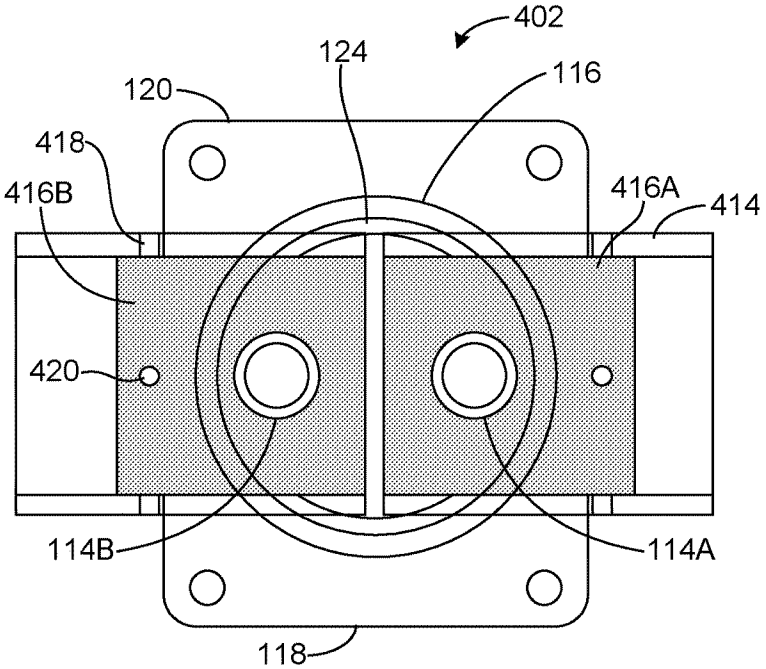
FIG. 7 is a top view of the example post of FIGS. 4-6.
Figure 6:
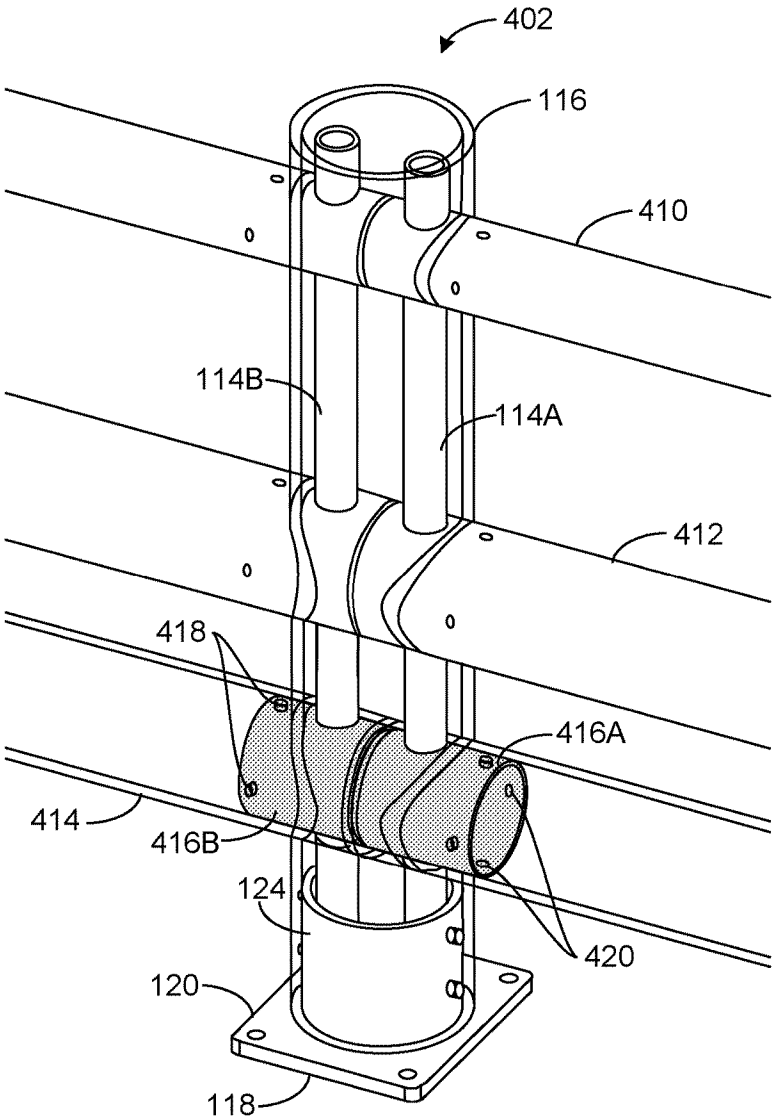
FIG. 6 is an enlarged perspective view of the example post of FIGS. 4 and 5.

FIG. 4 is a perspective view of another example barrier 400 implemented in accordance with teachings of this disclosure. FIG. 5 is a perspective view of the example barrier 400 with the first post shown in an exploded view. FIG. 6 is an enlarged view of a first post 402 of the example barrier 400. FIG. 7 is a top view of the first post 402 of the example barrier 400 with the first and second guard rails 410, 412 omitted to provide an unobstructed view of the third guard rail 414. Some of the components in FIGS. 4-7 are transparent or see-through for purposes of illustration to enable internal components to be visible. The example barrier 400 of FIGS. 4-7 is similar in design and construction to the example barrier 100 of FIGS. 1-3 except as noted below. As such, the description of similar components shown in FIGS. 1-3 applies equally with respect to the example barrier 400 of FIGS. 4-7. Likewise, features shown and described in connection with FIGS. 4-7 may be implemented in connection with the example barrier 100 of FIGS. 1-3. In view of the similarities between the two example barriers 100, 400, the same reference numerals will be used to identify the same or similar features between the two example barriers 100, 400.

In the illustrated example of FIG. 4, the barrier 400 includes an example first post 402, an example second post 404, and an example third post 406. In the illustrated example of FIG. 4, the barrier 400 includes an example first rail 410, an example second rail 412, and an example third rail 414. Thus, whereas the example barrier 100 of FIGS. 1-3 includes only two rails 110, 112, the example barrier 400 of FIGS. 4-7 includes three rails 410, 412, 414. However, in other examples, the barrier 400 of FIGS. 4-7 may include any suitable number of rails. A further difference between the barrier 100 of FIGS. 1-3 and the barrier 400 of FIGS. 4-7 is that the second and third rails 412, 414 are slight larger than the first rail 410. However, in other examples, the rails 410, 412, 414 may all be the same size or may all be different sizes. Further, the rails 410, 412, 414 in FIGS. 4-7 may be the same size or a different size than the rails 110, 112 of FIGS. 1-3. In the illustrated example of FIGS. 6-7, the third rail 414 is transparent (in addition to the outer body 116) for purposes of explanation to show the components disposed therein.

In the illustrated example of FIGS. 4-7, the rails 410, 412, 414 are coupled to the posts 402, 404, 406 and anchored to the ground or floor in substantially the same way as described above in connection with FIGS. 1-3. That is, as shown in the illustrated example, the first post 402 is secured to the ground via an anchor 118 that includes a base plate 120 and a cylindrical portion 124. The cylindrical portion 124 is to receive an outer body 116 that includes through holes through which the rails 410, 412, 414 extend. Further, the rails 410, 412, 414 include holes through which corresponding rods 114A, 114B extend to be held in a vertical orientation with a bottom end of the rods 114A, 114B engaging the base plate 120 within the cylindrical portion 124 of the anchor 118.

The post 402 of FIGS. 4-7 differs from the post 102 in FIGS. 1-3 in that the post 402 of FIGS. 4-7 includes an example first sleeve 416A and an example second sleeve 416B positioned within the third rail 414 at the location where the rods 114A, 114B pass through the third rail 414. For purposes of explanation, the sleeves 416A, 416B are shaded in the drawings to distinguish the sleeves from the surrounding components. The example sleeves 416A, 416B are comparatively high strength elements disposed within the inner diameter of the third rail 414. The sleeves 416A, 416B extend through the rail-receiving holes of the outer body 116 and into the portion of the rail 414 between the posts 102, 104, 106. In the illustrated example of FIG. 4, the sleeves 416A, 416B are approximately 5% of the length of the rail 414. In other examples, the sleeves 416A, 416B can be any suitable portion of the length of the rail 414 (e.g., 10% of the length, 25% of the length, etc.). The sleeves 416A, 416B increase the shear strength of the rail 414 by reducing the likelihood of the rail 414 shearing near the post 102, thereby increasing the strength of the barrier 100 to impacts. More particularly, in the illustrated examples, the sleeves 416A, 416B reinforce the rail 414 at or around the connection between the rail 414 and the rods 114A, 114B to prevent inelastic deformation of the rail as a result of a significant impact on the barrier.

In the illustrated example of FIG. 4, the sleeves 416A, 416B include through holes to enable the respective one of the rods 114A, 114B to pass therethrough. In the illustrated example of FIG. 4, the sleeves 416A, 416B are composed of a metal (e.g., steel, cast iron, aluminum, brass, etc.). In some such examples, the rods 114A, 114B and the anchor 118 are also composed of metal to provide direct metal-to-metal connections between the sleeves 416A, 416B and the rods 114A, 114B and between the rods 114A, 114B and the anchor 118 for increased structural integrity in the event of an impact with the barrier 400. In other examples, the sleeves 416A, 416B can be composed of any other suitable high strength material. While the illustrated example of FIGS. 4-7 only depicts the third rail 414 as including the sleeves 416A, 416B, in other examples, the other rails 410, 412 of the barrier 100 can include similar sleeves.

In the illustrated example, the third rail 414 includes holes 418 that align with corresponding holes 420 in the sleeves 416A, 416B to receive retaining elements (e.g., threaded fasteners, etc.) that facilitate the coupling of the sleeves 416A, 416B to the third rail 414. In some examples, fasteners extending through the holes 418, 420 maintain the position of the sleeves 416A, 416B within the rail 414 to prevent the sleeves 416A, 416B from moving concentrically within the rail 414. Likewise, the fasteners prevent the sleeves 416A, 416B from moving axially along the length of the rail 414. As a result, when the rail 414 is impacted, the force of the impact will transfer to the sleeves 416A, 416B to then be transferred to the vertical rods 114A, 114B. As the force acts on the rods 114A, 114B, the rods will contact the cylindrical portion 124 of the anchor 118, thereby transferring the force of the impact to the anchor 118, which is securely fastened to the floor. In this manner, the barrier 300 is able to withstand relatively significant impacts.

In some examples, some of the fasteners and/or corresponding holes 418, 420 can be absent. For example, the sleeve 416A can be coupled to the third rail 414 via any suitable number or type of fastener (e.g., screw, pin, etc.). In some examples, all of the fasteners and holes 418, 420 can be absent. In some such examples, the relative position of the sleeves 416A, 416B within the third rail 414 can be maintained by other suitable means (e.g., chemical adhesive, press fit, thermal-shrink fit, etc.).

In some examples, as shown in FIGS. 4 and 5, the post 402 includes an example cap 422 that is disposed on the top hole of the outer body 116. In some examples, as shown in FIG. 6, the cap 422 can be absent. In some examples, the cap 422 is composed of High Density Polyethylene (HDPE). In other examples, the cap 422 can be composed of any suitable materials (e.g., another plastic, a metal, a polymer, etc.) or combination thereof. The cap can be configured to connect to the outer body 116 by any suitable way (e.g., fasteners, adhesive, friction fit, etc.).

Figure 9:
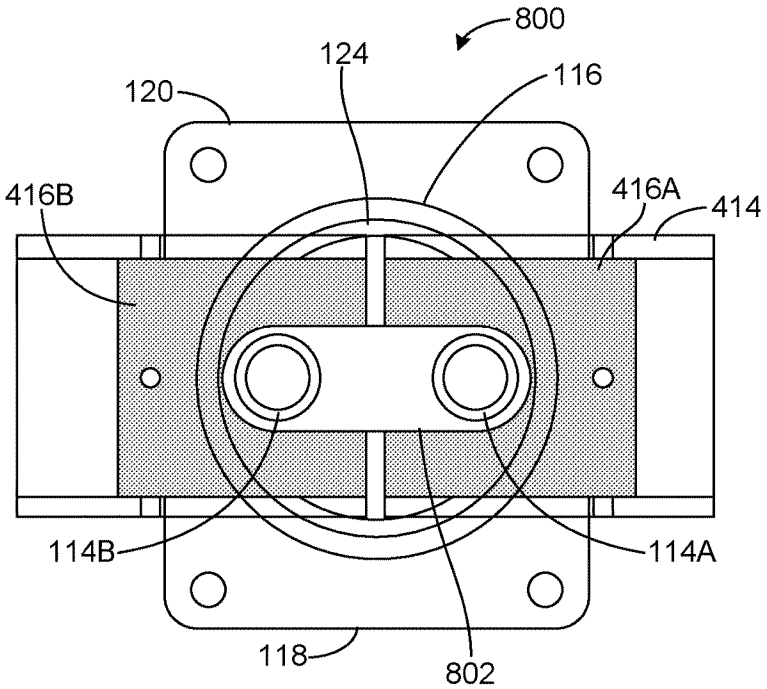
FIG. 9 is a top view of the example post of FIG. 8.
Figure 8:
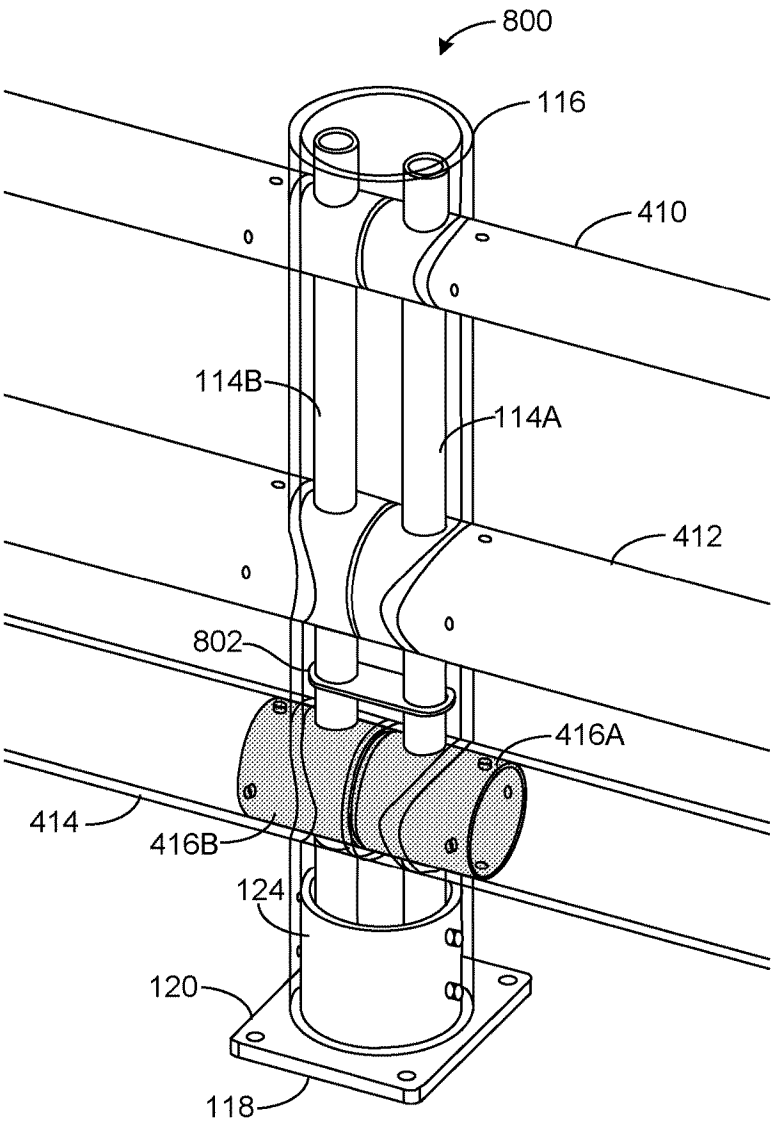
FIG. 8 is a perspective view of another example post implemented in accordance with teachings of this disclosure including an example post.

FIG. 8 is a perspective view of another example post 800 that may be used in conjunction with the example barriers 100 of FIGS. 1-3 and/or the example barrier 400 of FIGS. 4-7. FIG. 9 is a top view of the example post 800 of FIG. 8 with the first and second guard rails 410, 412 omitted to provide an unobstructed view of the third guard rail 414 and an example reinforcement 802. The example post 800 of FIG. 8 is substantially the same as the first post 402 shown and described above in connection with FIGS. 4-7 except as set forth below and, therefore, is labelled with the same reference numerals. However, as shown in the illustrated example of FIGS. 8 and 9, the example post 800 further includes an example reinforcement 802. In the illustrated example of FIGS. 8 and 9, the reinforcement 802 is a rigid plate that couples the first rod 114A to the second rod 114B. Alternatively, the reinforcement 802 can be an oval ring or other suitable structure to restrict the lateral movement of the rods 114A, 114B within the post 800. In the illustrated example of FIG. 8, the reinforcement 802 is disposed between the second rail 112 and the third rail 414. In other examples, the reinforcement 802 can be disposed at any other suitable location (e.g., between the first rail 410 and the second rail 412, under the third rail 414, etc.). Additionally or alternatively, additional reinforcements can be coupled between the first rod 114A and the second rod 114B. In some examples, the reinforcement 802 may be used to mechanically link or connect the two rods 114A, 114B while the sleeves 416A, 416B are omitted.

Figure 11:
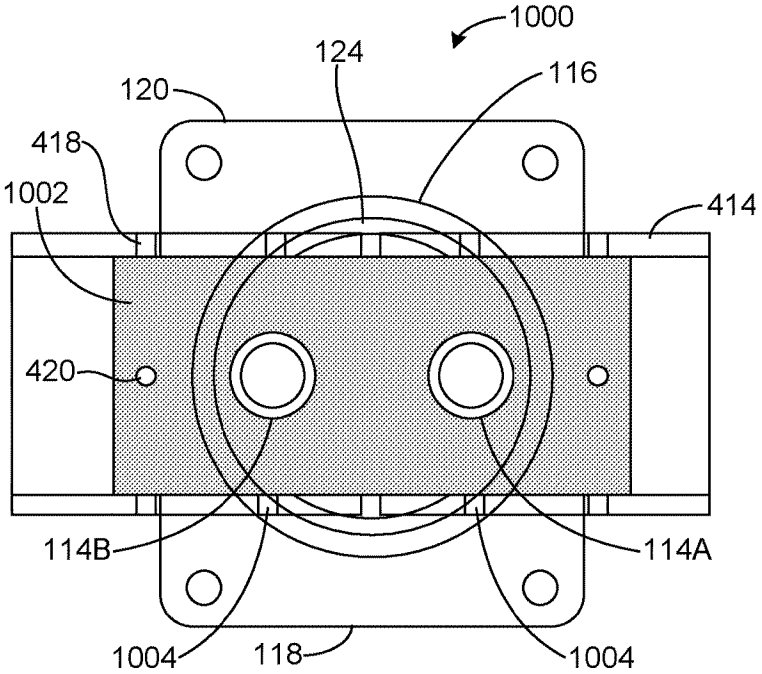
FIG. 11 is a top view of the example post of FIG. 10.
Figure 10:
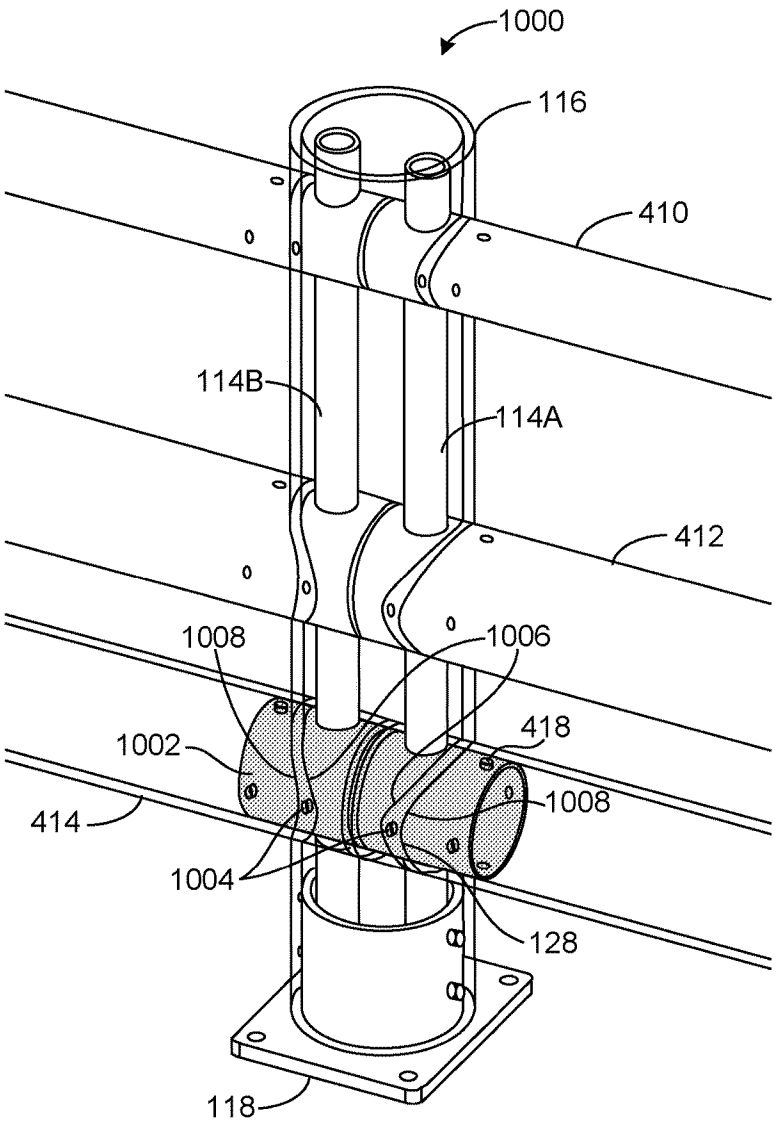
FIG. 10 is a perspective view of another example post implemented in accordance with teachings of this disclosure including an example post.

FIG. 10 is a perspective view of another example post 1000 that may be used in conjunction with the example barriers 100 of FIGS. 1-3 and/or instead of the example barriers 400, 800 of FIGS. 4-9. FIG. 11 is a top view of the example post 1000 of FIG. 10 with the first and second guard rails 410, 412 omitted to provide an unobstructed view of the third guard rail 414. In this example, a single sleeve 1002 is used in place of the two separate sleeves 416A, 416B shown in the examples of FIGS. 4-9 to reinforce the ends (and holes 206A, 206B) of both adjacent sections or segments of the rail 414 within the post 102. The single sleeve 1002 has two through holes, each to receive one of the vertical rods 114A, 114B. As such, the single sleeve 1002 functionally replaces both the sleeves 416A, 416B and the reinforcement 802. In some examples, the single sleeve 1002 that connects or links both rods 114A, 114B can be used in addition to the reinforcement 802 shown in FIGS. 8 and 9.

In some examples, as shown in FIGS. 10 and 11, additional holes 1004 in the third guard rail 414 provide additional points to maintain the rail 414 coupled to the internal sleeve 1002. In some examples, this coupling is achieved by threaded fasteners extending through the holes 1004 and corresponding holes in the sleeve 1002. In some examples, the additional holes 1004 are the only holes through which fasteners are placed to secure the guard rail 414 to the sleeve 1002. That is, in some examples, the holes 418 closer to the ends of the sleeve 1002 are omitted. Further, the particular position of the holes 418, 1004 are for purposes of explanation. In other examples, a different number of holes and/or different placements of the holes may be used. Further, in some examples, the same arrangement of holes and fasteners are used for all three of the guard rails 410, 412, 414 to secure each rail to a corresponding sleeve 1002. However, in other examples, different ones of the guard rails 410, 412, 414 (and associated sleeves) may include different numbers of holes (and associated fasteners) and/or the holes (and associated fasteners) may be in different locations relative to the other rails. For purposes of explanation, only the additional holes 1004 associated with the third guard rail 414 are described in detail.

As shown in the illustrated example, the additional holes 1004 are positioned in alignment with the wall of the outer body or shell 116 of the post 1000. That is, the holes 1004 (and thus the associated fasteners disposed therein) are positioned between an inner surface 1006 and an outer surface 1008 of the outer body 116. As a result, a fastener within the holes 1004 will engage and/or be in contact with the interfacing edge of the openings 128 surrounding the guard rail 414. Positioning the holes 1004 and associated fasteners so as to be partially or completely overlapped or covered by the thickness of the wall of the outer body 116 helps to retain the fasteners within the holes 1004, thereby ensuring the fasteners remain engaged with the sleeve 1002.

Furthermore, the above-disclosed arrangement of the additional holes 1004 also improves the strength of the assembly to resist failure during an impact. As already described, the force of an impact on the guard rail 414 is transferred to the sleeve 1002, from the sleeve 1002 to the rods 114A, 114B, and from the rods 114A, 114B to the anchor 118. In some examples, due to the properties of the material used for the guard rail 414 (e.g., a polymer) relative to the material used for the other components (e.g., metal), the rail 414 is likely to be the weakest point in the assembly. Thus, during an impact, the guard rail 414 may tear away from the sleeve 1002. However, with fasteners positioned underneath (e.g., retained by) the wall of the outer body 116 within the holes 1004, as shown in FIGS. 10 and 11, the outer body 116 can reduce the likelihood of the rail material cracking and/or or expanding in diameter to slide past the fasteners. Accordingly, separation of the rail 414 from the sleeve 1002 is likely to occur only when the fastener fully shears the rail material. As a result, the above arrangement increases the likelihood of impact forces being transferred to the anchor 118 without the rail 414 separating from the sleeve 1002.

While the additional holes 1002 are shown and described with reference to FIGS. 10 and 11, similar holes can be implemented in any of the other example posts 102, 104, 106, 402, 404, 406, 800 of FIGS. 1-9. More generally, the foregoing examples of the barriers 100, 400 and the associated posts 102, 104, 106, 402, 404, 406, 800, 1000 teach or suggest different features. Although each example barriers 100, 400 and the associated posts 102, 104, 106, 402, 404, 406, 800, 1000 disclosed above has certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc., may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, or (7) A with B and with C. As used herein in the context of describing structures, components, items, objects, and/or things, the phrase "at least one of A and B" is intended to refer to implementations including any of (1) at least one A, (2) at least one B, or (3) at least one A and at least one B. Similarly, as used herein in the context of describing structures, components, items, objects, and/or things, the phrase "at least one of A or B" is intended to refer to implementations including any of (1) at least one A, (2) at least one B, or (3) at least one A and at least one B. As used herein in the context of describing the performance or execution of processes, instructions, actions, activities, and/or steps, the phrase "at least one of A and B" is intended to refer to implementations including any of (1) at least one A, (2) at least one B, or (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, or (3) at least one A and at least one B.

As used herein, singular references (e.g., "a", "an", "first", "second", etc.) do not exclude a plurality. The term "a" or "an" object, as used herein, refers to one or more of that object. The terms "a" (or "an"), "one or more", and "at least one" are used interchangeably herein. Furthermore, although individually listed, a plurality of means, elements, or method actions may be implemented by, e.g., the same entity or object. Additionally, although individual features may be included in different examples or claims, these may possibly be combined, and the inclusion in different examples or claims does not imply that a combination of features is not feasible and/or advantageous.

Further examples and combinations thereof include the following:

Example 1 includes an apparatus comprising an outer body of a post to extend upward from a ground, the post to be anchored to the ground, a rail to extend through an opening in a wall of the outer body, and a rod to extend upward from the ground within the outer body, the rod to extend through a hole in the rail.

Example 2 includes the apparatus of example 1, further including a sleeve disposed within an inner diameter of the rail, the sleeve to be more rigid than the rail, the rod to extend through the sleeve.

Example 3 includes the apparatus of example 2, wherein the hole is a first hole, the rail including a second hole, the second hole to receive a fastener to retain the sleeve within the rail.

Example 4 includes the apparatus of example 3, wherein the second hole is to be aligned with the wall of the outer body so that the fastener is to be retained by an edge of the opening in the wall.

Example 5 includes the apparatus of any one of examples 2-4, wherein the outer body and the rail are composed of a polymer, and the rod and the sleeve are composed of metal.

Example 6 includes the apparatus of any one of examples 1-5, wherein the opening is a first opening and the rod is a first rod, the rail including a first segment and a second segment separate from the first segment, a first end of the first segment to extend through the first opening, a second end of the second segment to extend through a second opening in the wall of the outer body, the first rod to extend through the first segment, the apparatus further including a second rod disposed within the outer body, the second rod to extend through the second segment.

Example 7 includes the apparatus of example 6, further including a reinforcement to couple the first rod to the second rod.

Example 8 includes the apparatus of any one of examples 6 or 7, further including a sleeve to extend into the first segment of the rail and to extend into the second segment of the rail, the first rod to extend through a first hole in the sleeve, the second rod to extend through a second hole in the sleeve.

Example 9 includes the apparatus of any one of examples 1-8, wherein the hole is a slot with a length greater than a width, the slot to enable the rod to translate relative to the rail along the length of the slot.

Example 10 includes the apparatus of any one of examples 1-9, further including a base plate to facilitate anchoring of the post to the ground, and a cylindrical protrusion to extend upward from the base plate, the outer body to surround the cylindrical protrusion, the cylindrical protrusion to surround the rod.

Example 11 includes the apparatus of example 10, wherein the base plate and the cylindrical protrusion are metal, and the cylindrical protrusion is welded to the base plate.

Example 12 includes an apparatus comprising a post including a rod and an outer shell, the outer shell to surround the rod, a guard rail to be coupled to the rod within the outer shell, and a sleeve to be coupled to the rod and to the guard rail, both the sleeve and the guard rail to extend through an opening in a wall of the outer shell.

Example 13 includes the apparatus of example 12, wherein the sleeve is to be coupled to the rod and the guard rail to enable a transfer of a force of an impact on the guard rail to the rod.

Example 14 includes the apparatus of any one of examples 12 or 13, wherein the opening is a first opening, and the guard rail includes a first segment and a second segment, the first segment of the guard rail to extend from an interior of the post through the first opening, the second segment of the guard rail to extend from the interior of the post through a second opening in the outer shell.

Example 15 includes the apparatus of example 14, wherein the sleeve is coupled to both the first and second segments of the guard rail.

Example 16 includes the apparatus of example 14, wherein the sleeve is a first sleeve, the first sleeve disposed within the first segment of the guard rail, the apparatus further including a second sleeve disposed within the second segment of the guard rail, the second sleeve distinct from and spaced apart from the first sleeve.

Example 17 includes the apparatus of example 16, wherein the rod is a first rod, and the post includes a second rod within the outer shell, the first rod to extend through the first segment of the guard rail and through the first sleeve, the second rod to extend through the second segment of the guard rail and through the second sleeve.

Example 18 includes the apparatus of example 17, further including a reinforcement having first and second spaced apart holes, the first rod to extend through the first hole, the second rod to extend through the second hole.

Example 19 includes an apparatus comprising an anchor including a base plate and a cylindrical protrusion extending therefrom, a rod to extend away from the base plate within the cylindrical protrusion, the rod longer than the cylindrical protrusion, a rail to extend laterally away from the rod, the rod to extend through a hole in the rail, and a sleeve to reinforce the rail adjacent the hole.

Example 20 includes the apparatus of example 19, wherein the rod is a first rod and the rail is a first rail, the apparatus further including a second rod to extend away from the base plate within the cylindrical protrusion, and a second rail to extend laterally away from the second rod, the sleeve to be coupled to both the first rod and the second rod.

Example 21 includes the apparatus of example 19, wherein the rod is a first rod, the rail is a first rail, and the sleeve is a first sleeve, the apparatus further including a second rod to extend away from the base plate within the cylindrical protrusion, a second rail to extend laterally away from the second rod, and a second sleeve to reinforce the second rail, the second sleeve different than the first sleeve.

The following claims are hereby incorporated into this Detailed Description by this reference. Although certain example systems, methods, apparatus, and articles of manufacture have been disclosed herein, the scope of coverage of this patent is not limited thereto. On the contrary, this patent covers all systems, methods, apparatus, and articles of manufacture fairly falling within the scope of the claims of this patent.

What is claimed is:

1. An apparatus comprising:

an outer body of a post to extend upward from a ground, the post to be anchored to the ground;

a rail to extend through an opening in a wall of the outer body; and a rod to extend upward from the ground within the outer body, the rod to extend through a hole in the rail, the hole being a slot with a length greater than a width, the slot to enable the rod to translate relative to the rail along the length of the slot.

2. The apparatus of claim 1, further including a sleeve disposed within an inner diameter of the rail, the sleeve to be more rigid than the rail, the rod to extend through the sleeve.

3. The apparatus of claim 2, wherein the outer body and the rail are composed of a polymer, and the rod and the sleeve are composed of metal.

4. The apparatus of claim 1, wherein the opening is a first opening and the rod is a first rod, the rail including a first segment and a second segment separate from the first segment, a first end of the first segment to extend through the first opening, a second end of the second segment to extend through a second opening in the wall of the outer body, the first rod to extend through the first segment, the apparatus further including a second rod disposed within the outer body, the second rod to extend through the second segment.

5. The apparatus of claim 4, further including a reinforcement to couple the first rod to the second rod.

6. The apparatus of claim 1, further including:

a base plate to facilitate anchoring of the post to the ground; and a cylindrical protrusion to extend upward from the base plate, the outer body to surround the cylindrical protrusion, the cylindrical protrusion to surround the rod.

7. The apparatus of claim 6, wherein the base plate and the cylindrical protrusion are metal, and the cylindrical protrusion is welded to the base plate.

8. An apparatus comprising:

an outer body of a post to extend upward from a ground, the post to be anchored to the ground;

a rail to extend through an opening in a wall of the outer body;

a rod to extend upward from the ground within the outer body, the rod to extend through a first hole in the rail; and a sleeve disposed within an inner diameter of the rail, the sleeve to be more rigid than the rail, the rod to extend through the sleeve, the rail including a second hole, the second hole to receive a fastener to retain the sleeve within the rail.

9. The apparatus of claim 8, wherein the second hole is to be aligned with the wall of the outer body so that the fastener is to be retained by an edge of the opening in the wall.

10. An apparatus comprising:

an outer body of a post to extend upward from a ground, the post to be anchored to the ground;

a first segment of a rail, a first end of the first segment to extend through a first opening in a wall of the outer body;

a second segment of the rail separate from the first segment, a second end of the second segment to extend through a second opening in the wall of the outer body;

a first rod to extend upward from the ground within the outer body, the rod to extend through the first segment;

a second rod disposed within the outer body, the second rod to extend through the second segment; and a sleeve to extend into the first segment of the rail and to extend into the second segment of the rail, the first rod to extend through a first hole in the sleeve, the second rod to extend through a second hole in the sleeve.

11. An apparatus comprising:

a post including a rod and an outer shell, the outer shell to surround the rod;

a guard rail to be coupled to the rod within the outer shell; and a sleeve to be within the guard rail, the sleeve to be more rigid than the guard rail, both the sleeve and the guard rail to extend through an opening in a wall of the outer shell, the rod to extend through sleeve and a first hole in the guard rail, the guard rail including a second hole, the second hole to receive a fastener to retain the sleeve within the guard rail.

12. The apparatus of claim 11, wherein the sleeve is to be coupled to the rod and the guard rail to enable a transfer of a force of an impact on the guard rail to the rod.

13. The apparatus of claim 11, wherein the opening is a first opening, and the guard rail includes a first segment and a second segment, the first segment of the guard rail to extend from an interior of the post through the first opening, the second segment of the guard rail to extend from the interior of the post through a second opening in the outer shell.

14. The apparatus of claim 13, wherein the sleeve is coupled to both the first and second segments of the guard rail.

15. The apparatus of claim 13, wherein the sleeve is a first sleeve, the first sleeve disposed within the first segment of the guard rail, the apparatus further including a second sleeve disposed within the second segment of the guard rail, the second sleeve distinct from and spaced apart from the first sleeve.

16. An apparatus comprising:

a post including a first rod, a second rod, and an outer shell, the outer shell to surround the first rod and the second rod;

a guard rail to be coupled to the rod within the outer shell, the guard rail including a first segment and a second segment, the first segment to extend from an interior of the post through a first opening in a wall of the outer shell, the second segment to extend from the interior of the post through a second opening in the outer shell;

a first sleeve to be coupled to the rod and to the guard rail, the sleeve to extend through the first opening, the first rod to extend through the first segment of the guard rail and through the first sleeve; and a second sleeve disposed within the second segment of the guard rail, the second sleeve distinct from and spaced apart from the first sleeve, the second rod to extend through the second segment of the guard rail and through the second sleeve.

17. The apparatus of claim 16, further including a reinforcement having first and second spaced apart holes, the first rod to extend through the first hole, the second rod to extend through the second hole.

18. An apparatus comprising:

an anchor including a base plate and a cylindrical protrusion extending therefrom;

a first rod to extend away from the base plate within the cylindrical protrusion, the first rod longer than the cylindrical protrusion;

a first rail to extend laterally away from the first rod, the first rod to extend through a hole in the first rail;

a sleeve to reinforce the first rail adjacent the hole;

a second rod to extend away from the base plate within the cylindrical protrusion; and a second rail to extend laterally away from the second rod, the sleeve to be coupled to both the first rod and the second rod.

19. An apparatus comprising:

an anchor including a base plate and a cylindrical protrusion extending therefrom;

a first rod to extend away from the base plate within the cylindrical protrusion, the first rod longer than the cylindrical protrusion;

a first rail to extend laterally away from the first rod, the first rod to extend through a hole in the first rail; and a first sleeve to reinforce the rail adjacent the hole a second rod to extend away from the base plate within the cylindrical protrusion;

a second rail to extend laterally away from the second rod; and a second sleeve to reinforce the second rail, the second sleeve different than the first sleeve.

* * * * *